US005368447A

United States Patent [19]

Schwendemann et al.

[11] Patent Number: 5,368,447

[45] Date of Patent: Nov. 29, 1994

[54] WELL TESTING OR PRODUCTION FACILITY TRANSFER SYSTEM

[75] Inventors: Kenneth L. Schwendemann, Lewisville; Timothy M. Young, Coppell, both of Tex.

[73] Assignee: Halliburton Company, Houston, Tex.

[21] Appl. No.: 809,821

[22] Filed: Dec. 18, 1991

[51] Int. Cl.[5] ..... F04F 1/06

[52] U.S. Cl. ..... 417/54; 417/122; 417/125; 417/127; 417/128

[58] Field of Search ..... 417/122, 125, 123, 54, 417/127, 128, 63, 339, 392; 137/13; 210/188, 143, 104, 744

[56] References Cited

U.S. PATENT DOCUMENTS

| | | | |
|---|---|---|---|
| 1,628,608 | 5/1927 | Newhouse | 417/125 |
| 2,669,941 | 2/1954 | Stafford | 417/125 |
| 3,005,417 | 10/1961 | Swaney | 417/125 |
| 3,272,146 | 5/1964 | Bennett et al. . | |
| 3,552,884 | 7/1968 | Faldi . | |
| 3,556,682 | 8/1968 | Sakamoto et al. . | |
| 3,864,062 | 2/1975 | LeFur . | |
| 3,883,269 | 5/1975 | Wolff . | |
| 4,120,033 | 10/1978 | Corso | 417/63 |
| 4,253,255 | 3/1981 | Durell | 417/125 |
| 4,334,407 | 6/1982 | Barnes | 417/339 |
| 4,431,433 | 2/1984 | Gerlach | 417/404 |

*Primary Examiner*—Richard A. Bertsch
*Assistant Examiner*—Roland G. McAndrews, Jr.
*Attorney, Agent, or Firm*—Tracey W. Druce

[57] ABSTRACT

The present invention discloses a method and apparatus for a well testing or production facility system. More particularly, but not by way of limitation, the invention discloses a method and apparatus to transfer crude oil from a separator to an oil pipeline, or alternatively, to a burner flare. The method includes collecting oil in a separator, and then transferring the oil to a first, second, and third pump cylinder. The oil is sequentially forced from the cylinders by high pressure gas, and after being drained, the cylinders are again filled with crude oil. The apparatus includes a separator, a first, second and third pump cylinder which will sequentially receive crude oil. Sensing means are associated with the pump cylinders for sensing the level of crude oil within the cylinders. A control system is utilized to cycle a high pressure gas or air into each of the cylinders in order to force the oil out of the cylinders.

20 Claims, 6 Drawing Sheets

WELL TESTING OR PRODUCTION FACILITY TRANSFER SYSTEM

BACKGROUND OF THE INVENTION:

This invention relates to an apparatus and process for transferring crude oil. More particularly, but not by way of limitation, the invention relates to an apparatus and process to transfer crude oil from a storage location to an oil pipeline.

In the oil and gas industry, when a hydrocarbon reservoir is produced, the well effluent is often a mixture of oil and gas. In order to accurately measure the amount of hydrocarbons produced, as well as to eventually sell the product, the operator finds it necessary to separate the oil and gas. In remote locations, such as offshore or arctic regions, the process for separating the oil and gas is particularly important for economic reasons.

In normal situations, an oil and gas separator is used downstream of the producing well. In this separator, the initial separation of the produced oil, gas, and water takes place. The gas may then be vented out to a gas pipeline, or in the more exotic locations, to a flare where the gas is burned.

The oil thus produced is transferred to a stock tank for further settling and separation of any residual gas. The amount of retention time required depends on the specific physical qualities of the oil and gas.

The oil then must be transferred to a pipeline, or in the case of a drill stem test, the oil is pumped to a flare for burning. In either case, the transfer is completed by a transfer pump which is usually a diesel engine and pump.

Finally, oil is flown through a metering skid which measures the amount of oil produced. The metering device is generally a turbine meter but may also consist of a positive displacement apparatus.

The apparatus and process of the prior art has several distinct disadvantages. First, the use of a diesel pump and engine is expensive. The pumps require a substantial start-up cost and also require regular maintenance and repair. Further, these pumps are very heavy and bulky, and if the use of the pumps is in remote areas, logistical problems require expensive solutions. Finally, the diesel pumps require significant amounts of fuel, which because of the remote location and cost, also exacerbate logistical problems.

Therefore, there is a need for an apparatus and process which can transfer crude oil from a storage location to a pipeline which will eliminate the large and costly use of diesel engines, pumps and metering skids.

SUMMARY OF THE INVENTION

The present invention includes both apparatus and method claims for a well testing or production facility transfer system. The method or process of the present invention includes producing the oil and gas from a hydrocarbon bearing reservoir, collecting the oil and gas in a separator, separating the oil and gas into two different phases, and wherein the gas is used to operate a control system. Next, the oil is transferred from the separator into the stock tank. Then the oil is drained into a first pump cylinder.

After sensing when the first pump cylinder has reached a maximum capacity, oil from the stock tank is then transferred into a second pump cylinder. Once the maximum capacity has been sensed in cylinder two, the oil from the first pump cylinder is then pressure forced into the oil outlet. Simultaneously with the sensing of the maximum amount of oil in cylinder two, oil is then transferred from the stock tank to a third pump cylinder. Again, the maximum amount of oil is sensed, and pressure will be applied to force the oil out of cylinder two into the oil out line. Simultaneously with the sensing of the maximum level in cylinder three, oil will be transferred to cylinder one, where the sequence will be repeated until all of the oil from the stack tank has been transferred to the oil out line.

The process can further comprise the steps of measuring the amount of oil discharged from each cylinder and calculating the total amount transferred to the oil out line. The process thus far described contained three pump cylinders; however, two pump cylinders could have been utilized as well as greater than three cylinders.

An apparatus is also claimed as part of the invention. The apparatus will include a stock tank in communication with the separator for collecting the crude oil drained from the separator, with the stock tank containing an oil discharge line and a gas vent line. The apparatus also includes a first cylinder pump containing a gas line inlet, an oil line inlet and an oil line outlet.

A second cylinder pump containing a gas line inlet, an oil line inlet and an oil line outlet is also included. Control systems means is also furnished, which is located downstream of the separator and in communication with a gas vent line, for controlling the gas pressure from said separator to the first and second cylinder pump.

The apparatus further comprises first and second sensing means for sensing the maximum and minimum capacity of the first and second cylinder pump. A first and second valve means, operably associated with the sensing means, is contained thereon for discharging the first cylinder pump once the cylinders have reached maximum capacity and the valve means are operable between an open position and a closed position.

Also included is venting means, operably connected to the control system means, for venting any excess gas from the separator, and activating means for activating the first and second valve means to the open position in response to a signal produced by said sensing means.

The invention further comprises a first and second valve intake means, connected to the separator oil out line and operably associated with the sensing means, for allowing the intake of the oil from the stock tank into the first and second cylinder pump.

The first and second cylinder pump may contain an impermeable barrier which would be of the same general configuration as that of the internal diameter of the pump. Thus, if the pump is cylindrical, the barrier is circular and can be constructed of styrofoam or other suitable material. The barrier is buoyed by the oil in the first and second cylinder pump and provides a barrier between the oil and gas so that as high gas is placed into the cylinders, the gas is not put back into the oil solution.

In one embodiment, the sensing means comprises: a first lower pneumatic level control disposed within the first cylindrical pump so that as the oil level within the pump decreases to a minimum level, the first lower pneumatic level control sends an air signal to the first valve means; and a second lower pneumatic level control disposed within the second pump so that as the oil level within the pump decreases to a minimum level, the second lower pneumatic level control sends an air signal to the second valve means; a first upper pneumatic level control disposed within the first cylinder pump so that as the oil level within the first pump increases to a certain level, the first upper pneumatic level control sends an air signal to the first valve means; and a second upper pneumatic level control disposed within the second pump so that as the oil level within said second cylinder pump increases to a maximum level, the second upper pneumatic level control sends an air signal to the second valve means.

The apparatus can further contain measurement means for measuring the amount of crude oil forced into the oil out line. Further, the apparatus thus described has two pump cylinders; however, multiple cylinders can be used. In fact, in the preferred embodiment, three pump cylinders are employed, as more fully explained hereafter.

A feature of the invention is the two pneumatic level control valves located within the pump cylinders, with one of the control valves sensing a high level and the other sensing a low level. Another feature of the invention includes having a pneumatic controlled valve trigger a two-position valve which allows the introduction of high pressure gas, while a second signal to the control valve communicates the pump to an atmospheric line.

Another feature entails the use of a pressure sensitive valve which will sense the pressure in the cylinder to which it is connected and open the cylinder to the oil outlet line once the requisite pressure is applied. Yet another feature includes an oil in pilot control valve which will in accordance to a first signal allow oil into the cylinder and in response to a second signal close-off the cylinder to the oil supply.

Still another feature is having an impermeable barrier separate the oil and gas so that less gas is placed back into the oil solution. Another feature includes the use of natural gas from the well as a supply source for the pneumatic system. Still another feature includes the use of an air supply source, such as an air compressor, to be the source of the high pressure gas.

An advantage of the system is the elimination of the diesel engine, pumps and fuel from the transfer system. Another advantage of the system includes discharging oil into a relatively low pressure oil out line. Another advantage includes allowing the high pressure gas from the separator to be flown to the pump cylinders, to a flare line, or to gas pipeline.

Another advantage includes the use of either natural gas or compressed air to force the oil from the cylinders. Still another advantage is the option of using two or more cylinders depending on the location of the oil that is to be transferred.

DETAILED DESCRIPTION OF THE PREFERRED EMBODIMENT

Figure 1:
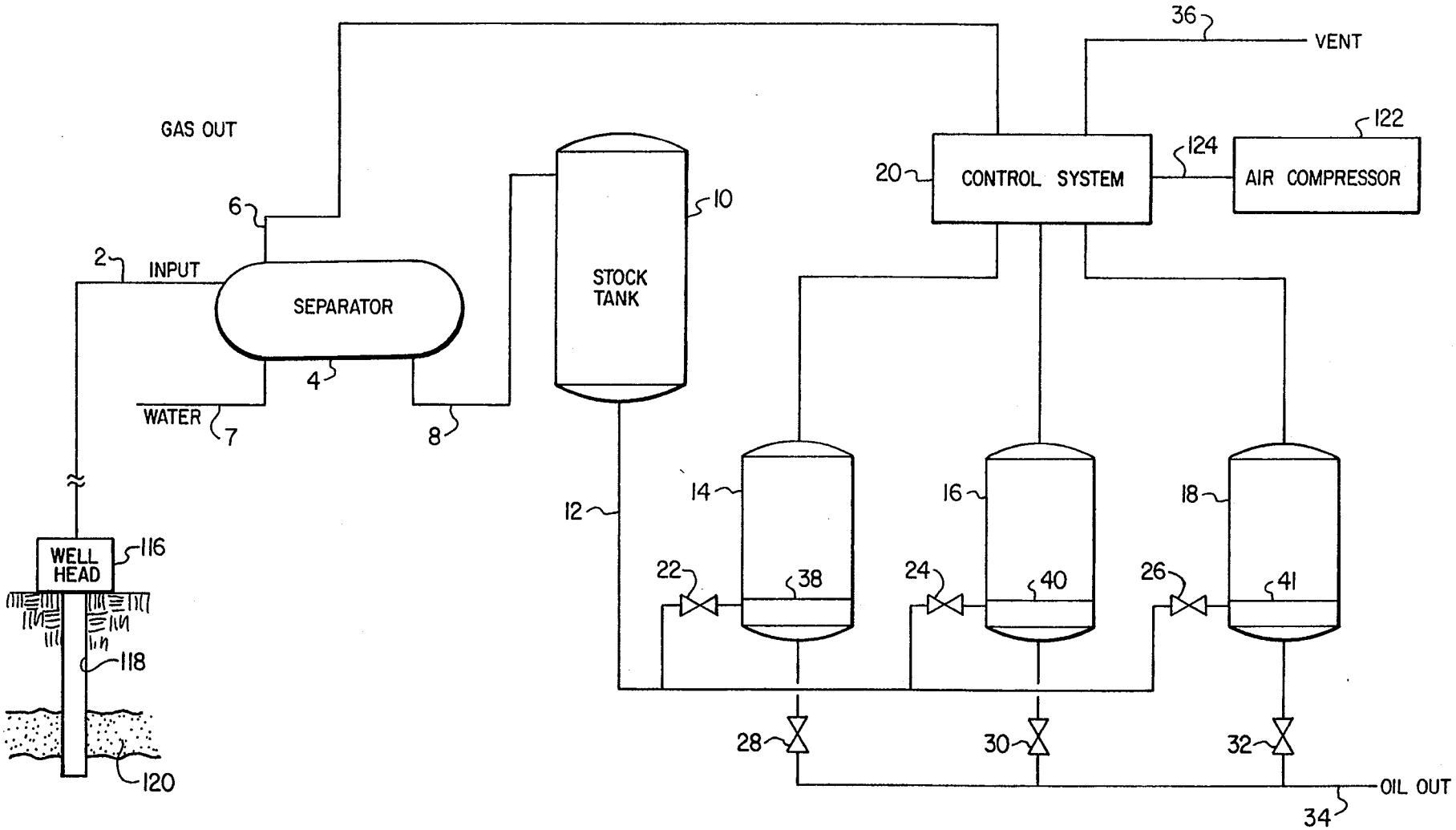
FIG. 1 is a schematic diagram depicting one embodiment of the entire system.

Referring to FIG. 1, a schematic diagram is shown which depicts one embodiment of the entire system. It should be noted that FIG. 1 shows three pump cylinders which will be used in cyclic sequence; however, two pump cylinders could have been used, or in the alternative, greater than three pump cylinders could have been used. The exact number of cylinders is a matter of design choice.

The input line 2 of the separator 4 is generally connected to a wellhead 116 which is connected to a wellbore (118). The wellbore will penetrate a hydrocarbon bearing reservoir as will be appreciated by those skilled in the art. Thus, as the reservoir is produced, the hydrocarbons will flow into the separator 4 via the input line 2.

The separator 4 typically employed will be a three phase separator which will separate oil, gas and water. Thus, the gas out line 6 (also known as the gas vent line) will lead gas out of the separator, the water out line 7 will discharge the produced water, and the oil out line 8 will flow the oil to the stock tank 10. The stock tank 10 allows for further settling of the produced oil so that gas in the oil solution can migrate out. The stock tank, therefore, may act as a separator. Also, the stock tank acts as a measuring device.

In the prior art, the stock tank may act as a reservoir for the transfer pump. Under the teachings of the present invention, the stock tank acts in the same type of capacity i.e. a temporary holding tank. The stock tank 10 will have an oil out line 12 which will lead to the pump cylinders 14, 16, and 18.

The gas out line 6 will lead to the control system means 20 for directing the flow of the high pressure gas into the cylinders 14, 16, and 18. The control system means will also activate two-position pilot valves 22, 24, and 26. The oil out valves 28, 30, and 32 are pressure sensitive valves which are normally closed position valves which are opened once the requisite pressure is applied to the corresponding cylinder. The oil out valve could be a pilot operated two position valve. Once valves 28, 30, and 32 are opened, the oil is forced out by the high pressure gas.

The oil out line 34 is connected to the oil out valves 28, 30, and 32 and can be connected to an oil pipeline and sold. Alternatively, the line 34 can be connected to a flare line and the oil can be burned to the atmosphere.

The control system means will also contain a vent line 36 which will vent excess gas or vent gas from the cylinders during operation.

Also shown is impermeable barrier means 38, 40, and 41 which may be placed in the pump cylinders. The impermeable barriers may comprise a styrofoam member which will be of the same general configuration of the pump cylinder. Thus, since the internal structure will be of a general circular shape, the impermeable barriers means will also be of a circular configuration.

The barrier means 38, 40, and 41 will serve as a barrier between the oil and gas. As will be more fully developed hereinafter, as oil is allowed into the cylinder, the barrier will raise or float on the oil. Once gas is injected into the cylinder by the control means, the barrier will provide an impediment for the gas to enter into the oil solution.

Figure 2:
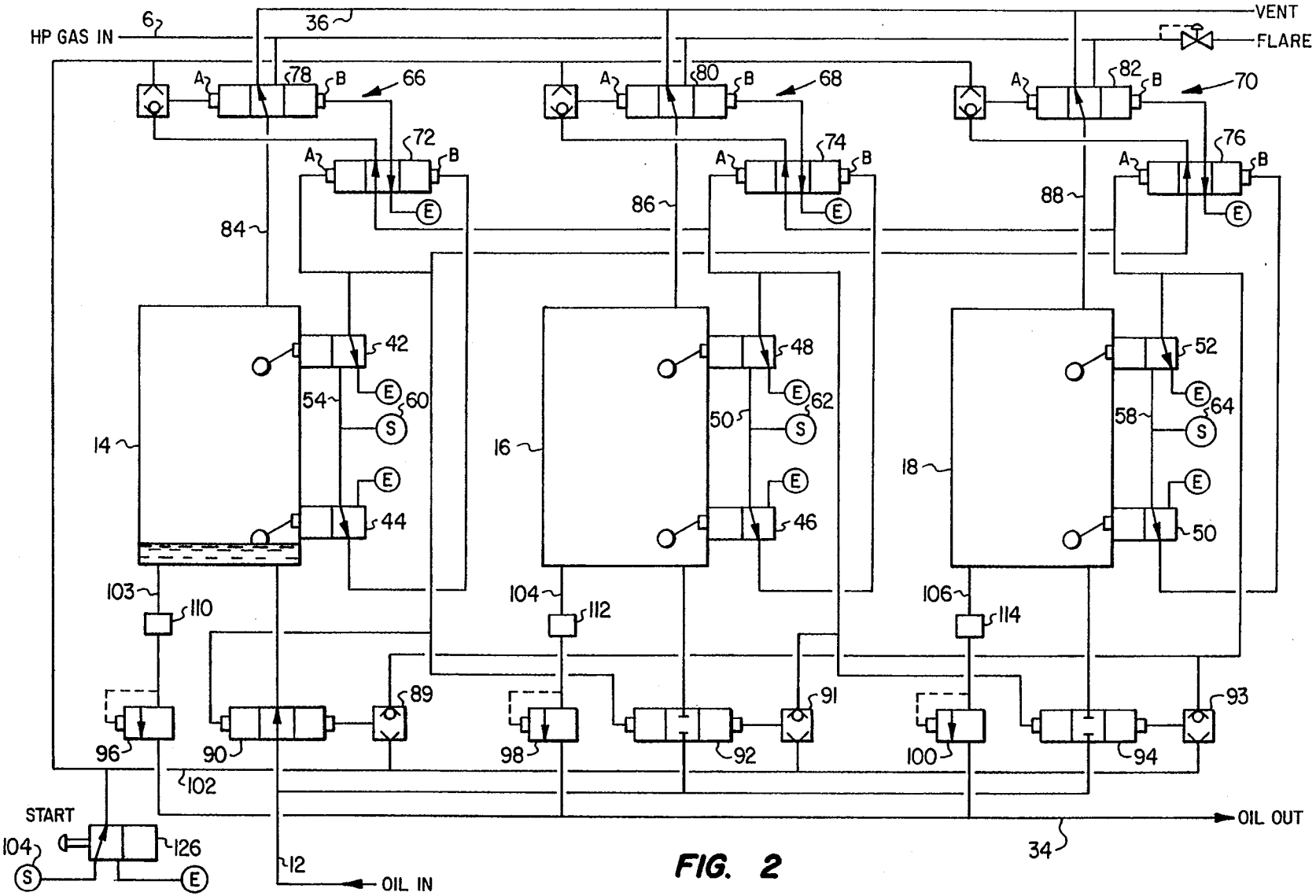
FIG. 2 is a schematic diagram of the pneumatic circuit of the present invention when cylinder 1 being filled with oil.

In the preferred embodiment, and referring to FIG. 2, cylinder 14 will have associated therewith a low level sensing means 44 and high level sensing means 42. Cylinders 16 and 18 will also have low level and high level sensing means 46, 48, 50, and 52, respectively. These sensing means may be float actuated pneumatic pilot control valves. A ¼" pneumatic control line 54, 56 and 58 jointly connect the low level sensing means with the high level sensing means on each of the cylinders. The pneumatic control lines 54, 56 and 58 will have attached thereto an air supply source 60, 62, and 64.

Valve means, operably associated with the sensing means, is seen at 66, 68, and 70. The valve means may also be referred to as first, second and third chamber valve means. The valve means will generally comprise of 2-position pneumatic control valves 72, 74, and 76. A typical valve of this type can be purchased from Pneumatic Controls Suppliers. The valve means will also contain a 2-position air operated valve 78, 80, and 82 which may also be referred to as pressurize/vent valves 78, 80, and 82. Valves 72, 74, and 76 will receive signals from the low and high level sensing means. These signals will activate either the first side, designated as side A of the valves 72, 74 and 76, or the second side, designated as side B. The valve will then transmits(or trigger) this signal to the appropriate valve 78, 80 or 82. Depending on the signal received, the valves 78, 80 or 82 will position accordingly. The valves 78, 80 and 82 are linked to the high pressure gas line 6 as well as to the atmospheric vent line 36 on one side and cylinder lines 84, 86, and 88 on the other. Therefore, depending on the signal received from valve 72,74, and 76, the cylinders 14,16, and 18 will be placed in communication with either the high pressure line or the atmospheric line.

The high level sensing means 42, once activated by the oil level, will also send a signal to a first and second 2-position pilot operated valve 90 and 92, which are also known as oil-in valves. The signal sent to valve 90 will be sent via the ¼" control line which will transmit air pressure which will close the valve 90, while the same signal to valve 92 will open that valve.

The high level sensing means 48, once activated, will also send a signal to the 2-position pilot operated valve 92 as well as valve 94, similarly referred to as an oil in-valve. The signal sent to valve 92 will be sent via the ¼" control line to the shuttle valve 91 which will in turn transmits air pressure on the side which will close the valve 92, while the same signal to valve 94 will be sent to the side which will open that valve.

As shown in FIG. 2, the high level sensing means 52, once activated by a high level of oil in cylinder 18, will also send a signal to 2-position pilot operated valve 94, which is another oil-in valve. The signal sent to valve 94 will be sent by means of the ¼" control line to the shuttle valve 93 which will in turn transmit air pressure on the side which will close valve 94 as transmitted through the shuttle valve 93, while the same signal will be sent to valve 90 such that valve 90 will open as transmitted through shuttle valve 89.

Pressure sensitive control valves 96, 98 and 100 are connected to cylinders 14, 16, and 18, respectively by means of lines 103, 104, and 106. Finally, the oil out line 34 is connected to each of the pressure sensitive control valves 96, 98, and 100. The lines 103, 104 and 106 have first, second and third measurement means 110, 112 and 114, respectively, disposed therein for measuring the amount of oil discharged from their respective cylinders to the oil outline 34.

It should be noted that in the figures, the "S" represents the supply source of air or natural gas, and the "E" represents the exhaust for the pneumatic valves.

Operation

Referring to FIG. 2, the cyclic sequence will now be explained. First, oil line 12 will be connected to valves 90, 92, and 94, which are two-position pilot operated valves. Valves 90, 92, and 94 have a first position which allows flow through the valve and a second position which blocks flow through the valve. The valve, as noted, contains a pilot actuated controller means which will move the valve from its first position to the second position. The controller means will be connected to an air supply means through a ¼" pneumatic supply line.

Normally, at start-up, the valves 92 and 94 are in the closed position and valve 90 is open because of the position of valve 126. Momentary activation of the start valve 126 will position valve 90 open, and valves 92 and 94, as closed; also, valves 78, 80, and 82 are open between the cylinder and vent. The pneumatic line 102 is connected to an air supply source 104 and valve 126. Valve 126 is a manually operated pneumatic control valve; thus, as the valve 126 is manually opened i.e. allowing air pressure into the line 102, shuttle valve 89 will then transfer air pressure to the actuator of valve 90 which will in effect open the valve 90 allowing oil from the oil in line 12 to transfer into cylinder 14. Valves 92 and 94 will go to the closed position because shuttle valve 91 and 93 will transmit the air pressure signal to the closed position half of valves 92 and 94.

Oil will begin transferring into cylinder 14. Once the level of oil in cylinder 14 reaches the high level sensing means 42, the sensing means will then transmit an air signal to the valve means 66. In particular, the air signal will be sent to the 2-position valve 72, which will in turn transmit pressure to the actuator on side B of valve 78.

As noted earlier, when the high level sensing means is triggered by the oil in cylinder 14, a signal is sent to the valve means 66. A signal has also been sent to the two position valve 92 such that valve 92 will shift to the open position and allow oil into cylinder 16 from the oil in line 12.

Figure 3:
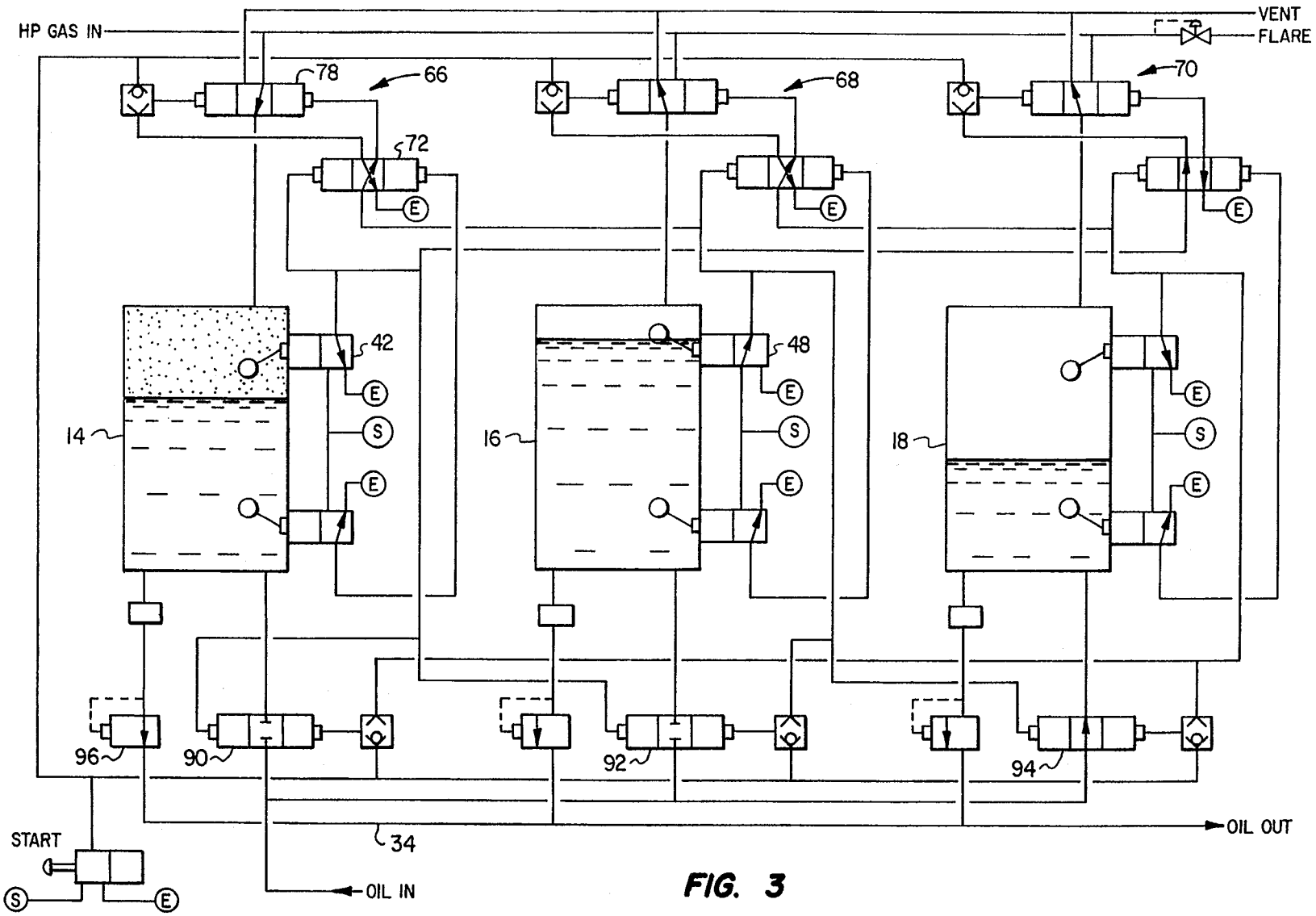
FIG. 3 is a schematic diagram of the pneumatic circuit of the present invention when high pressure gas has been placed in cylinder 1.

Thus, oil will be transferring into cylinder 16. Referring to FIG. 3, once the level has reached the high level sensing means (48), a signal will be sent to the valve means 68. The sensing means signal will also supply an air signal to valve 72 and this will cause valve 78 to switch so that cylinder 14 is in communication with the high pressure line 6. Also, a signal will be sent to valve 94 which will cause that valve to be placed in the open position relative to the oil in line 12; consequentially, oil will begin transferring into the cylinder 18.

Once pressure is applied to the cylinder 14, the oil will be placed under pressure. However, pressure sensitive valve 96 will not open until the requisite pressure has been applied. Once this requisite pressure is applied, the valve 96 will open and the oil in cylinder 14 will be forced out by the high pressure gas into the oil out line 34.

Figure 4:
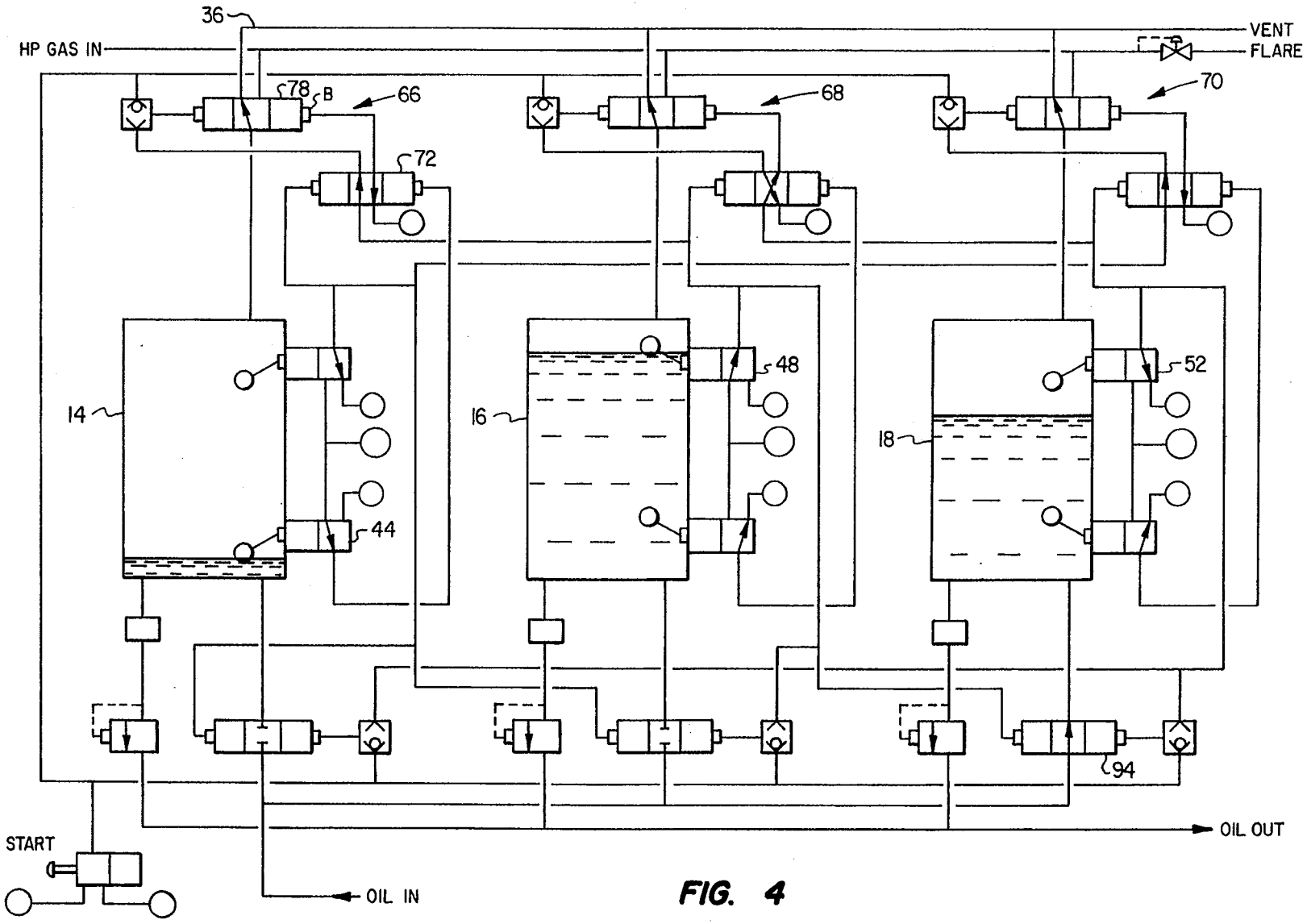
FIG. 4 is a schematic diagram of the pneumatic circuit of the present invention after high pressure gas has forced oil out of cylinder 1 and the sensing means is sensing a low level in cylinder 1.

Referring to FIG. 4, as the oil in cylinder 14 reaches the low level sensing means 44, the sensing means 44 will send a signal to valve means 66 thereby taking the high pressure gas off of the cylinder 14, and venting the cylinder 14 to the atmosphere vent line 36. In particular, the signal to the valve means 66 will function as follows. The air signal to the pneumatic control valve 72 will cause valve 72 to switch. This will then cause an air signal to be sent to the B half of valve 78, causing that valve to switch to the position wherein the cylinder 14 is in communication with the vent line 36.

Figure 5:
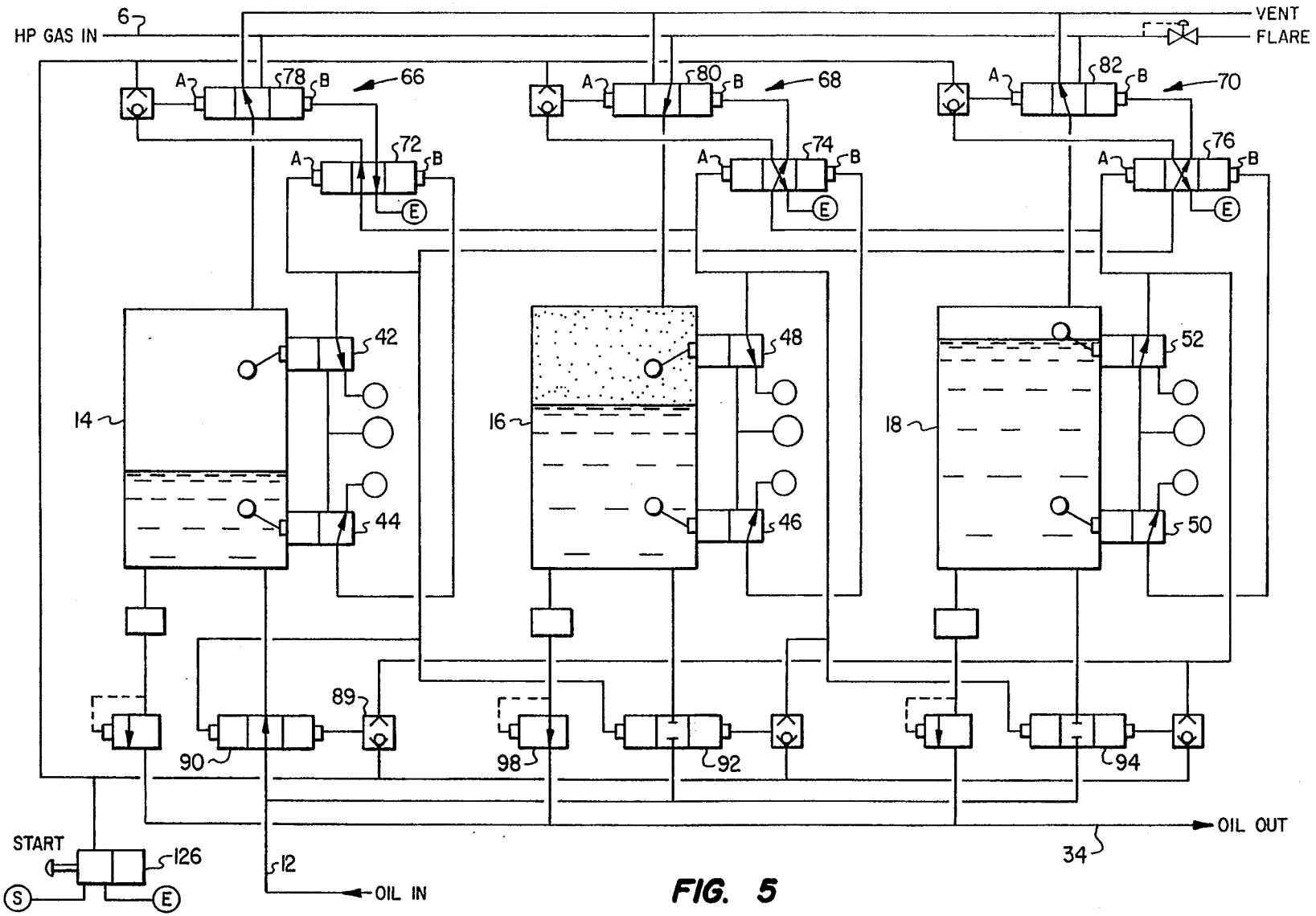
FIG. 5 is a schematic diagram of the pneumatic circuit of the present invention when high pressure gas has been placed in cylinder 2.

Meanwhile, cylinder 18 has been filling with oil from oil in line 12 via valve 94. As seen in FIG. 5, once the oil reaches the high level sensing means 52, a signal will be sent to the valve means 70 and air is supplied to valve means 74, which will cause high pressure gas to be directed into the cylinder 16. The valve means switching will occur as follows. The air signal from sensing means 52 will cause 2-position pneumatic control valve 76 to switch, and a signal is sent to valve 80 on B side wherein the 2-position valve 80 will align with the high pressure line 6.

Once the high pressure gas is communicated with the cylinder 16, the oil will be placed under pressure until the requisite magnitude of pressure is applied and pressure sensitive valve 98 will open, and oil will then be forced to flow into oil out line 34.

Similar to the sequence in the other two cylinders, the high level sensing means 52 will also send an air signal to the shuttle valve 89 which will transmit that signal to the actuator of 2position valve 90 and effectively switch valve 90 so that valve 90 is now in communication with the oil in line 12. Thus, oil will begin transferring into cylinder 14 and the cycle can be repeated, as previously described.

Figure 6:
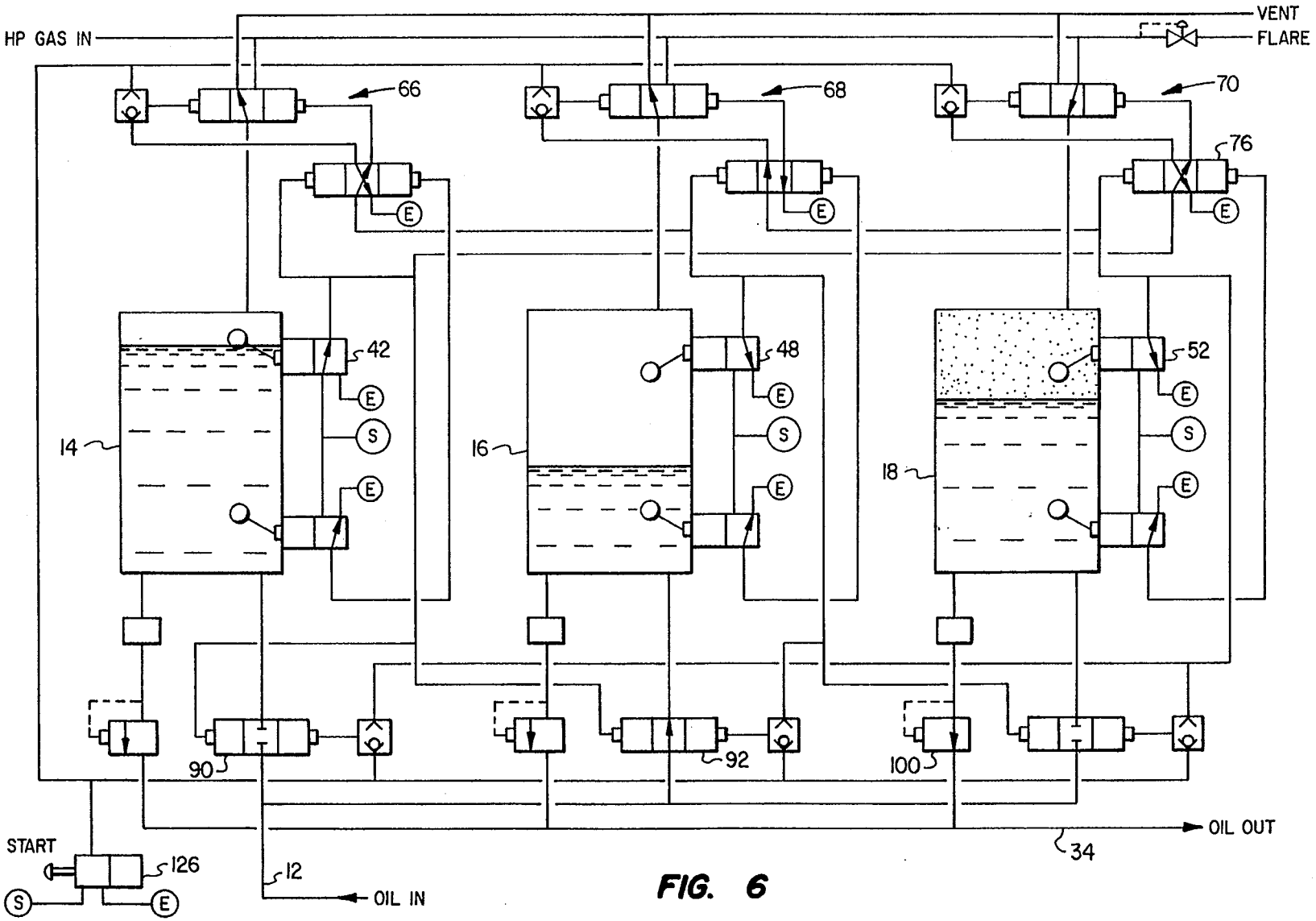
FIG. 6 is a schematic diagram of the pneumatic circuit of the present invention when high pressure gas is forcing oil out of cylinder 3 and the sensing means is sensing a high level in cylinder 1.

Next, referring to FIG. 6, cylinder 14 will fill with oil, and thus the high level sensing means 42 will send a signal to valve 90 which will close that valve, a signal to valve 92 which will open that valve so that oil begins flowing into cylinder 16, and a signal to valve means 76, which will cause high pressure gas to be directed into cylinder 18. Consequently, valve 100 will open, allowing oil to be forced into the oil out line 34. The cycling can be repeated as often as necessary. For instance, oil will continue to flow into cylinder 16 and the stage shown in FIG. 3 would be the next sequence.

While in the embodiment disclosed, the high pressure gas employed was gas taken from the three-phase separator, it is to be understood that any supply of high pressure gas can be used such as an air compressor. Thus, when high pressure natural gas is either not available or is impracticable to use, compressed air will be utilized. FIG. 1 schematically illustrates this air compressor 122 supplying high pressure air to control system 20 through supply line 124.

As an added step in the above process, an accurate measurement can be taken of the liquid which has been cycled through the cylinders and placed into the oil out line 34. Since the quantity of oil between the high level sensing means (42, 48, and 52) and the low level sensing means (44, 46, and 50) are known, the number of times the cylinder is discharged will then provide the amount of oil placed into the oil out line 34. Therefore, measurement means can be employed for measuring the number of times the cylinders have cycled (dumped) oil in order to determine the amount of oil transferred through the system.

Thus, it is seen that the apparatus and methods of the present invention readily achieve the ends and advantages mentioned as well as those inherent therein. While certain preferred embodiments of the invention have been illustrated and described for the purposes of the present disclosure, numerous changes in the arrangement and construction of parts and steps may be made by those skilled in the art, which changes are encompassed within the scope and spirit of the present invention as defined by the appended claims.

What is claimed is:

1. A process for transferring an oil stored in a stock tank comprising:

(a) supplying pressure to a control system;

(b) transferring the oil to a first pump cylinder;

(c) transferring oil to a second pump cylinder once the volume of oil in the first pump cylinder reaches a predetermined volume;

(d) pressuring the oil in the first pump cylinder by means of the control system once a predetermined volume has been sensed in the second pump cylinder;

(e) transferring the oil in the first pump cylinder to an oil outlet line.

2. The process of claim 1 further comprising the steps of:

(f) transferring the oil from the stock tank to a third pump cylinder once the oil in the second pump cylinder reaches a high point;

(g) pressuring the oil in the second pump cylinder by means of the control system once a predetermined volume has been sensed in the third pump cylinder;

(h) transferring the oil in the second pump cylinder to the oil outlet line.

3. The process of claim 2 further comprising the steps of:

(i) transferring the oil from the stock tank to the first pump cylinder once the oil in the third pump cylinder reaches a high point;

(j) pressuring the oil in the third pump cylinder by means of the control system once a predetermined volume has been sensed in the first pump cylinder;

(k) transferring the oil in the third pump cylinder to the oil outlet line.

4. The process of claim 3 further comprising the steps of:

(l) repeating the steps of c–k until the stock tank has been emptied of the oil.

5. The process of claim 4 wherein the step of supplying pressure to the control system has been supplied at a constant rate of pressure.

6. A process for transferring crude oil comprising:

(a) producing oil and gas from a hydrocarbon reservoir;

(b) collecting the oil and gas in a separator at the surface;

(c) venting the gas from the separator to a control system;

(d) transferring the oil from the separator to a stock tank;

(e) flowing the oil from the stock tank to a first pump cylinder;

(f) sensing when the first pump cylinder has reached a maximum capacity and simultaneously stopping the flow of oil from the stock tank to the first pump cylinder and flowing the oil from the stock tank to a second pump cylinder;

(g) applying gas pressure from the control system to the first pump cylinder;

(h) forcing the crude oil in the first pump cylinder to an oil outlet line;

(i) sensing when the second pump cylinder has reached a maximum capacity and simultaneously stopping the flow of oil from the stock tank to the second pump cylinder and flowing the oil from the stock tank to the first pump cylinder; and (j) applying gas pressure from the control system to the second pump cylinder;

(k) forcing the crude oil in the second pump cylinder to an oil outlet line.

7. The process of claim 6 further comprising the steps of:

(l) sensing when the first pump cylinder has reached a maximum capacity and simultaneously stopping the flow of oil from the stock tank to the first pump cylinder and flowing the oil from the stock tank to the second pump cylinder;

(m) applying gas pressure from the control system to the first pump cylinder;

(n) forcing the crude oil in the first pump cylinder to an oil outlet line;

(o) applying gas pressure from the control system to the second pump cylinder;

(p) sensing when the second pump cylinder has reached a maximum capacity and simultaneously stopping the flow of oil from the stock tank to the second pump cylinder and flowing the oil from the stock tank to the first pump cylinder; and (q) forcing the crude oil in the second pump cylinder to an oil outlet line.

8. The process of claim 7 further comprising the step of:

(r) measuring the amount of oil flowed into the first cylinder pump before forcing the crude oil to the oil outlet line; and (s) measuring the amount of oil flowed into the second cylinder pump before forcing the crude oil to the oil outlet line.

9. The process of claim 8 further comprising the steps of:

(t) repeating steps a.–t. until all of the oil from the separator has been transferred to the oil outlet line.

10. An apparatus for pumping crude oil from a stock tank to an oil pipeline, the apparatus comprising:

a first, second and third pump chamber connected in parallel;

gas supply means for supplying pressurized gas to said first, second and third pump chambers;

control system means for controlling the supply of the gas to said first, second and third pump chambers;

sensing means, attached to said first, second and third pump chambers, for sensing a quantity of the crude oil contained in said first, second and third pump chambers;

first oil valve means, connected to the stock tank, for allowing the flow of the crude oil into the first, second and third pump chambers, said first oil valve means having an open and a closed position and being operably associated with said sensing means so that said first oil valve means allows oil to flow into each respective pump chamber when a predetermined volume of oil is sensed in the preceding pump chamber;

second oil valve means, connected to the oil pipeline, for allowing the flow of the crude oil from the first, second and third pump chambers, said second oil valve means having an open and a closed position;

actuating means, operably associated with said sensing means, for actuating said first oil valve means from the closed position to the open position so that crude oil can flow from the stock tank to said first pump cylinder chamber.

11. The apparatus of claim 10 wherein said control system means comprises:

first chamber valve means, responsive to said sensing means and operably associated with said first chamber, for allowing the communication of the gas to said first chamber;

second chamber valve means, responsive to said sensing means and operably associated with said second chamber, for allowing the communication of the gas to said second chamber;

third chamber valve means, responsive to said sensing means and operably associated with said third chamber, for allowing the communication of the gas to said third chamber; and wherein said first chamber valve means comprises:

a first two-position control valve having a first position and a second position, said first control valve being responsive to said sensing means so that said first control valve is in said first position when said first pump chamber is empty of oil and so that said first control valve is in said second position when said sensing means senses that said second pump chamber is full of oil, and a first pressurize/vent valve having a pressurizing position and a vent position, operably associated with said first two-position control valve, so that when said first control valve is in its second position said first pressurize vent valve will be in its said pressurizing position thereby placing said first pump chamber in communication with said gas supply means, and so that said first pressurize/vent valve will be in its said vent position when said first control valve is in its first position, thereby venting said first pump chamber.

12. The apparatus of claim 11, wherein said gas supply means is natural gas produced from a well completed in a hydrocarbon reservoir.

13. The apparatus of claim 11, wherein said gas supply means is compressed air produced from an air compressor.

14. An apparatus for transferring crude oil from an oil and gas separator to an oil outlet line, the apparatus comprising:

a stock tank in communication with the separator for collecting the crude oil drained from the separator, said separator containing an oil discharge line and gas vent line;

a first cylinder pump containing a gas line inlet, an oil line inlet, an oil line outlet and an internal diameter;

a second cylinder pump containing a gas line inlet, an oil line inlet, an oil line outlet and an internal diameter;

first sensing means, operably associated with the first cylinder pump, for sensing the maximum and minimum level of oil of the first cylinder pump and producing a signal in response thereto;

second sensing means, operably associated with the second cylinder pump, for sensing the maximum and minimum level of oil of the second cylinder pump and producing a signal in response thereto;

control system means, located downstream of the separator and in communication with the gas vent line, for controlling the gas pressure from said separator to the first and second cylinder pump and wherein said control system provides said first cylinder pump with gas from the separator in response to the first sensing means sensing a maximum level of oil and the control system provides the second cylinder pump with gas from the separator in response to the second sensing means sensing a maximum level of oil;

a first pressure sensitive valve, associated with the first cylinder pump and operable between an open position and a closed position, for sensing the pressure within the first cylinder pump and switching to the open position once a requisite amount of pressure has been applied;

a second pressure sensitive valve, associated with the second cylinder pump and operable between an open position and a closed position, for sensing the pressure within the second cylinder pump and switching to the open position once a requisite amount of pressure has been applied;

first and second venting means, operably connected to the control system means, for venting excess gas pressure from the first and second pump cylinders once a signal is received from the first and second sensing means respectively, sensing a low level of oil.

15. The apparatus of claim 14, further comprising:

first pump valve intake means, connected to the separator oil outline and operably associated with the second sensing means, for allowing the intake of the oil from the stock tank into the first cylinder pump once the second cylinder pump has reached maximum capacity; and second pump valve intake means, connected to the separator oil outline and operably associated with the first sensing means, for allowing the intake of the oil from the stock tank into the second cylinder pump once the first cylinder pump has reached maximum capacity.

16. The apparatus of claim 15, wherein the first and second cylinder pump contains an impermeable barrier, said impermeable barrier being of the same general configuration as the internal diameter of the first and second cylinder pump so that the impermeable barrier is buoyed by the oil in said first and second cylinder pump and wherein said impermeable barrier provides a barrier between the oil and gas.

17. The apparatus of claim 16, wherein said impermeable barrier is made of styrofoam.

18. The apparatus of claim 15, wherein said first and second sensing means comprises:

a first lower pneumatic level control disposed within said first cylinder pump so that as the oil level within said first cylinder pump decreases to a certain level, the first lower pneumatic level control sends a signal to the control system means to vent the first cylinder pump to the vent line;

a second lower pneumatic level control disposed within said second cylinder pump so that as the oil level within said second cylinder pump decreases to a certain level, the second cylinder pump sends a signal to the control system means to vent the second cylinder pump to the vent line;

a first upper pneumatic level control disposed within said first cylinder pump so that as the oil level within said first cylinder pump increases to a certain level, the first upper pneumatic level control sends a signal to the control system means to vent the first cylinder pump to the high pressure gas line; and a second upper pneumatic level control disposed within said second cylinder pump so that as the oil level within said second cylinder pump increases to a certain level, the second cylinder pump sends a signal to the control system means to vent the second cylinder pump to the high pressure gas line.

19. The apparatus of claim 15, further comprising:

first measurement means for measuring the amount of oil discharged from the first cylinder pump into the oil line outlet; and second measurement means for measuring the amount of oil discharged from the second cylinder pump into the oil line outlet.

20. A control system apparatus for cycling a first, second and third cylinder pump structure, the apparatus comprising:

a high pressure line connected to a high pressure source;

an atmospheric line vented to the atmosphere;

a first cylinder pump having a low sensing means for sensing the low state and a high sensing means for sensing the high state, said high and low sensing means being a pneumatic level control valve;.

a second cylinder pump having a low sensing means for sensing the low state and a high sensing means for sensing the high state, said high and low sensing means being a pneumatic level control valve;

a third cylinder pump having a low sensing means for sensing the low state and a high sensing means for sensing the high state, said high and low sensing means being a pneumatic level control valve;

first means for venting the high pressure line to the first cylinder pump, said venting means contain a two-position valve and a pneumatic control valve;

second means for venting the high pressure line to the second cylinder pump, said venting means containing a two-position valve and a pneumatic control valve;

third means for venting the high pressure line to the third cylinder pump, said venting means containing a two-position valve and a pneumatic control valve;

means for discharging said first cylinder, said discharging means containing a pressure sensitive valve;

means for discharging said second cylinder, said discharging means containing a pressure sensitive valve; and means for discharging said third cylinder, said discharging means containing a pressure sensitive valve.

* * * * *